US008770134B2

(12) United States Patent
Baugh

(10) Patent No.: US 8,770,134 B2
(45) Date of Patent: Jul. 8, 2014

(54) STRUCTURALLY-INTERLAMINATED MARINE VESSEL

(76) Inventor: Carl E. Baugh, Glen Rose, TX (US)

( * ) Notice: Subject to any disclaimer, the term of this patent is extended or adjusted under 35 U.S.C. 154(b) by 184 days.

(21) Appl. No.: 13/459,601

(22) Filed: Apr. 30, 2012

(65) Prior Publication Data

US 2013/0284082 A1 Oct. 31, 2013

(51) Int. Cl.
*B63B 5/02* (2006.01)

(52) U.S. Cl.
USPC ..... 114/358; 114/82

(58) Field of Classification Search
USPC ..... 114/82, 84, 358, 65 R
IPC ..... B63B 3/02,5/02, 5/06
See application file for complete search history.

(56) References Cited

U.S. PATENT DOCUMENTS

| | | | | |
|---|---|---|---|---|
| 1,336,866 | A * | 4/1920 | Schlueter | 114/84 |
| 2,391,990 | A * | 1/1946 | Luders | 114/88 |
| 4,208,369 | A | 6/1980 | Kohn | |
| 4,239,008 | A | 12/1980 | Conlon | |
| 4,295,910 | A | 10/1981 | Cooley et al. | |
| 4,301,202 | A | 11/1981 | Kohn | |
| 4,351,680 | A | 9/1982 | Kohn | |
| 4,508,047 | A * | 4/1985 | Bordat | 114/355 |
| 4,599,256 | A * | 7/1986 | Vasilos | 428/114 |
| 7,131,471 | B2 * | 11/2006 | McIntosh | 144/348 |
| 8,652,606 | B2 * | 2/2014 | Griess et al. | 428/60 |
| 2010/0035015 | A1 | 2/2010 | Green et al. | |

FOREIGN PATENT DOCUMENTS

| | | | |
|---|---|---|---|
| CA | 1077229 | A1 | 5/1980 |
| CN | 2562659 | Y | 7/2003 |
| CN | 201627334 | U | 11/2010 |
| WO | 2007112652 | A1 | 10/2007 |

* cited by examiner

*Primary Examiner* — Stephen Avila
(74) *Attorney, Agent, or Firm* — Hahn Loeser & Parks LLP

(57) ABSTRACT

A method of constructing a marine vessel. The method includes structurally interlaminating a first plurality of components to form a first element of a marine vessel, structurally interlaminating a second plurality of components to form a second element of the marine vessel, and structurally interlaminating at least a first portion of the first element with at least a first portion of the second element to form a first combined element of the marine vessel. Also, a marine vessel. The marine vessel includes a first element including a first plurality of structurally interlaminated components, and a second element including a second plurality of structurally interlaminated components, wherein at least a first portion of the second element is structurally interlaminated with at least a first portion of the first element.

14 Claims, 8 Drawing Sheets

STRUCTURALLY-INTERLAMINATED MARINE VESSEL

TECHNICAL FIELD

Embodiments of the subject matter disclosed herein relate generally to marine vessels and, more specifically, to marine vessel construction wherein elements of the marine vessel each comprise a plurality of structurally interlaminated components themselves structurally interlaminated together to form a structurally interlaminated marine vessel.

BACKGROUND

A marine vessel requires a structure having characteristics of strength, formability, low maintenance, and durability. Presently, the construction of marine vessels having wooden components is limited by the strength of the wooden components. There is presently a need for a method of constructing a marine vessel out of wooden components that can exceed the dimensions of marine vessels constructed from conventional methods.

SUMMARY

Presently disclosed is a method of constructing a marine vessel. An embodiment of the method includes the steps of, structurally interlaminating a first plurality of components to form a first element of a marine vessel, structurally interlaminating a second plurality of components to form a second element of the marine vessel, and structurally interlaminating at least a first portion of the first element with at least a first portion of the second element to form a first combined element of the marine vessel. Such a method may further include structurally interlaminating a third plurality of components to form a third element of the marine vessel, and structurally interlaminating at least a second portion of the first element with at least a first portion of the third element to form a second combined element of the marine vessel. Also, the method may include structurally interlaminating a fourth plurality of components to form a fourth element of the marine vessel, and structurally interlaminating at least a second portion of the second element with at least a first portion of the fourth element to form a third combined element of the marine vessel. The process may continue by interlaminating additional elements in a similar manner, in accordance with an embodiment, to complete the marine vessel.

Structural interlamination of adjacent components provides a stronger marine vessel than marine vessels constructed from conventional methods, permitting the marine vessel made from the presently disclosed methods to have larger dimensions than conventional marine vessels.

Optionally, in accordance with an embodiment, each component of the marine vessel may be saturated with a carbon-based resin adapted to penetrate into the pores of each component and to provide adhesion between adjacent, structurally-interlaminated components to form structurally-interlaminated elements. Heat and force may be exerted on opposing sides of the structurally-interlaminated elements to cure the carbon-based resin and force the natural fibers and resins of each adjacent component together to form a single unified structure.

Additionally, a marine vessel is disclosed. An embodiment of a marine vessel includes a first element including a first plurality of structurally interlaminated components, and a second element including a second plurality of structurally interlaminated components, wherein at least a first portion of the second element is structurally interlaminated with at least a first portion of the first element. Additionally, the marine vessel may further include a third element including a third plurality of structurally interlaminated components, wherein at least a first portion of the third element is structurally interlaminated with at least a second portion of the first element. Optionally, the marine vessel may include a further fourth element including a fourth plurality of structurally interlaminated components, wherein at least a first portion of the fourth element is structurally interlaminated with at least a second portion of the second element. Additional elements may be added, as needed, to complete the marine vessel.

In accordance with an embodiment, each component of the marine vessel may be a porous hardwood component, prepared in thin strips to form laminates between adjacent porous hardwood components. Each porous hardwood component is capable of being saturated with a carbon-based resin such that each component may be adhered together to form a continuous single structure. The carbon-based resin also inhibits ingress of water into the structurally-interlaminated elements of the marine vessel. Such carbon-based resin may be birch-bark resin, for example.

Also disclosed is a marine vessel. An embodiment of a marine vessel includes a hull having a plurality of structurally interlaminated elements, each structurally interlaminated element formed from a plurality of structurally interlaminated components. The marine vessel also includes at least one bulkhead comprising a plurality of structurally interlaminated elements, each structurally interlaminated element formed from a plurality of structurally interlaminated components. The marine vessel further includes and at least one deck member comprising a plurality of structurally interlaminated elements, each structurally interlaminated element formed from a plurality of structurally interlaminated components. The hull, the at least one bulkhead, and the at least one deck are structurally interlaminated with each other to form a structurally interlaminated marine vessel, in accordance with an embodiment. The hull, the at least one bulkhead, and the at least one deck are structurally interlaminated with each other to form a single integrated structurally interlaminated marine vessel.

In accordance with an embodiment, the marine vessel may further include at least one water vessel comprising a plurality of structurally interlaminated elements configured for holding water. The water vessel may be configured to provide structural stability to the marine vessel, and may be structurally-interlaminated with the marine vessel.

These and other advantages and novel features of the present invention, as well as details of illustrated embodiments thereof, will be more fully understood from the following description and drawings.

DETAILED DESCRIPTION

Figure 1:
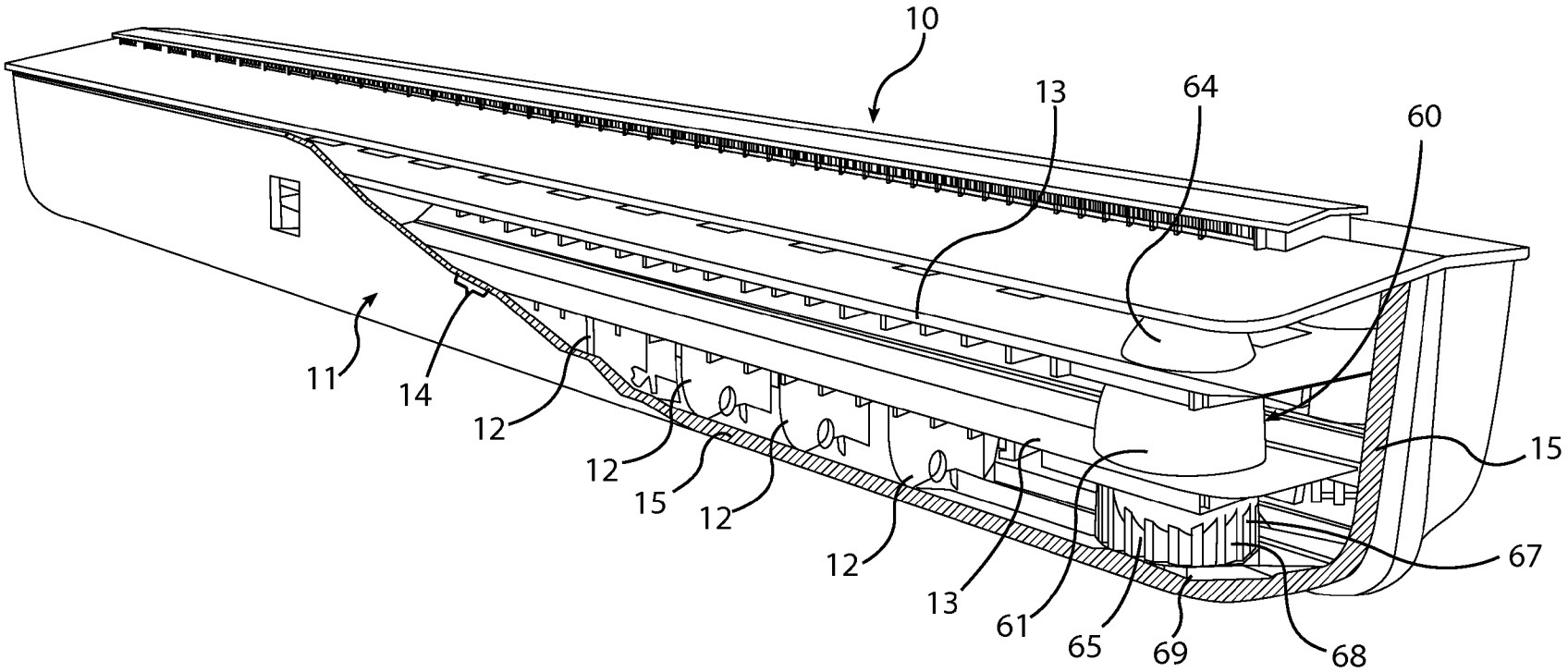
FIG. 1 illustrates an example embodiment of a marine vessel constructed by an example embodiment of the presently disclosed method.

FIG. 1 illustrates a wooden marine vessel 10 having a hull 11, at least one bulkhead 12 and at least one deck 13, formed from an embodiment of the presently disclosed method. The wooden marine vessel 10 may be formed by structurally interlaminating a plurality of wooden elements 14, each element of the marine vessel 10 may be formed from structurally interlaminating a plurality of wooden components 15 (e.g., see FIG. 3). Where the marine vessel 10 is wooden, each wooden component 15 may be a relatively thin strip of wood, such as a porous hard wood. Each wooden component 15 may be layered with other wooden components 15 to form a wooden element 14 of a plurality of wooden components 15, or laminae. A wooden element 14 formed from a plurality of structurally interlaminated components 15 is stronger than a wooden element of the same dimensions having a single non-laminated wooden structure.

The components 15 of each wooden element 14, may be structurally interlaminated with the components 15 of each adjacent wooden element 14, to form a unified structurally interlaminated structure. In this way, each element 14 of the marine vessel 10 may be structurally interlaminated together. In some embodiments the marine vessel 10 may be formed from a plurality of structurally interlaminated elements, each element structurally interlaminated with adjacent structurally interlaminated elements to form a single structurally interlaminated marine vessel 10. A marine vessel 10 having a single structurally interlaminated structure formed by the presently disclosed method is stronger than a marine vessel having the same dimensions formed from conventional wooden building materials.

Figure 2:
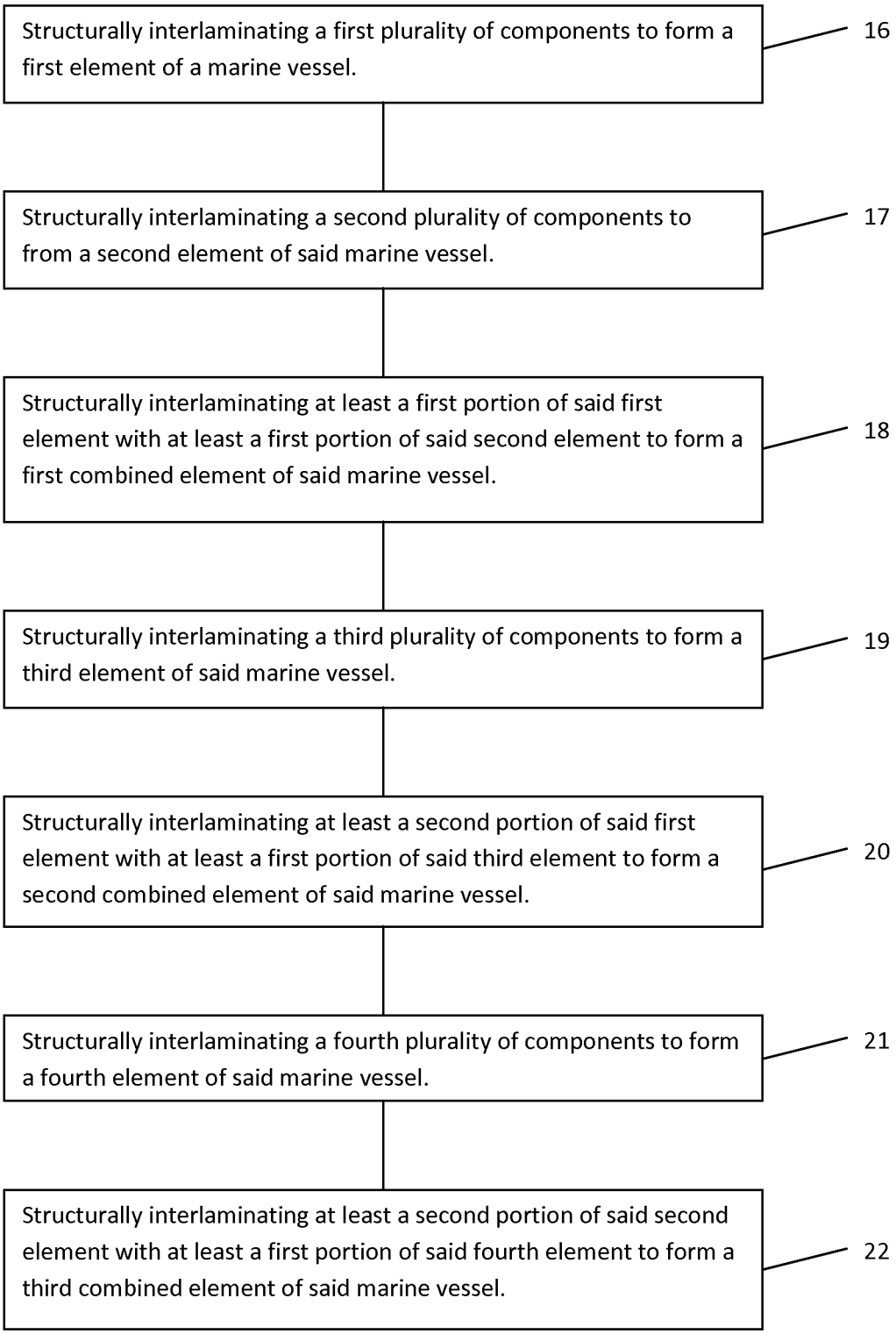
FIG. 2 is a flow chart of an example embodiment of the presently disclosed method.

FIG. 2 shows a flow chart illustrating an embodiment of the presently disclosed method. Presently disclosed is a method of constructing a marine vessel 10. The method includes the steps of:

(a) structurally interlaminating a first plurality of components to form a first element of a marine vessel (step 16);

(b) structurally interlaminating a second plurality of components to form a second element of the marine vessel (step 17); and, (c) structurally interlaminating at least a first portion of the first element with at least a first portion of the second element to form a first combined element of the marine vessel (step 18).

In some embodiments the method may further include the steps of:

(d) structurally interlaminating a third plurality of components to form a third element of the marine vessel (step 19); and (e) structurally interlaminating at least a second portion of the first element with at least a first portion of the third element to form a second combined element of the marine vessel (step 20).

Further, such embodiments may further include the steps of:

(f) structurally interlaminating a fourth plurality of components to form a fourth element of the marine vessel (step 21); and (g) structurally interlaminating at least a second portion of the second element with at least a first portion of the fourth element to form a third combined element of the marine vessel (step 22).

The method may be further expanded to add additional elements to the marine vessel as deemed necessary.

Figure 3:
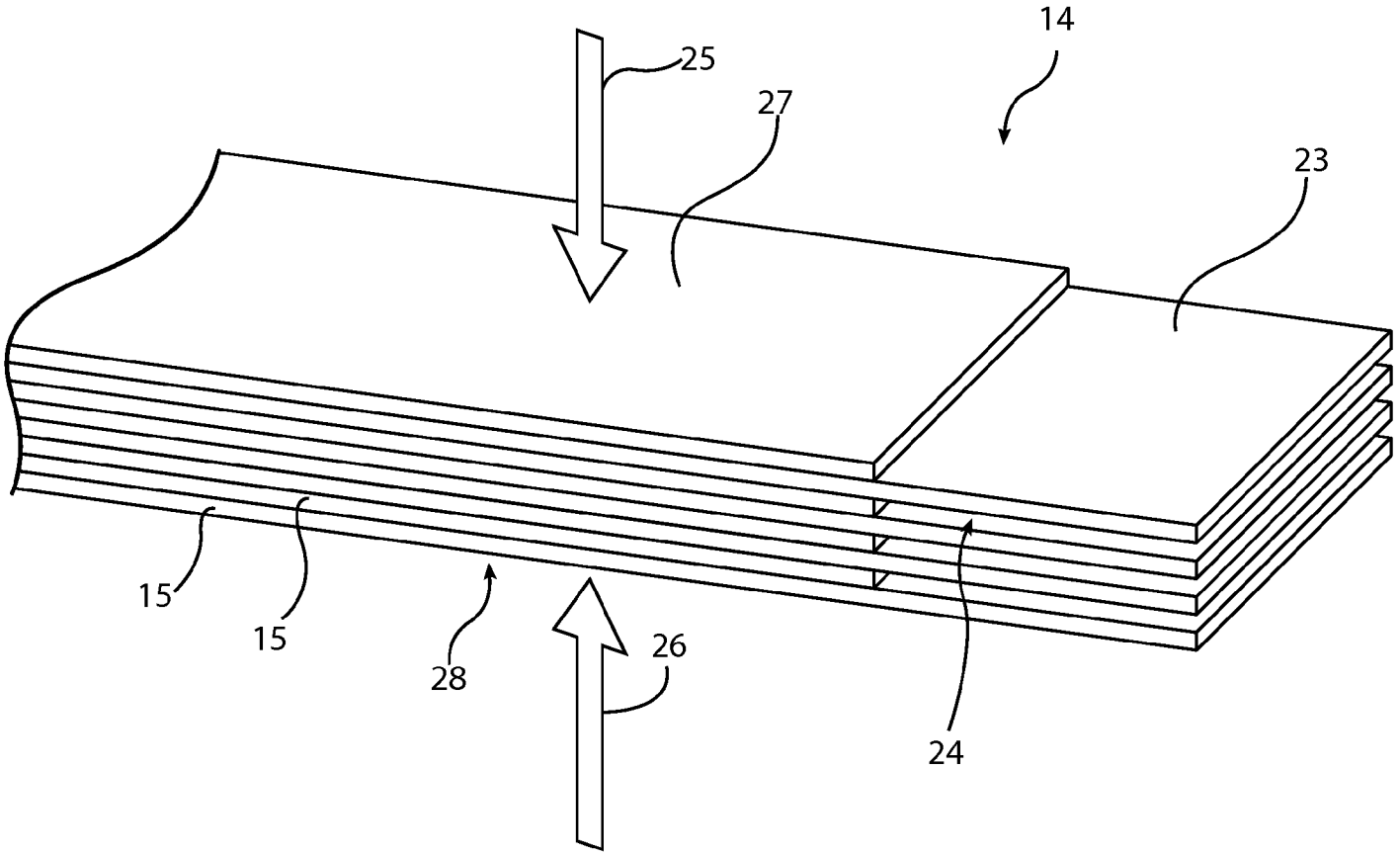
FIG. 3 illustrates an example embodiment of a structurally interlaminated first plurality of components.

With reference to FIG. 3, an embodiment of a marine vessel 10 may have structurally-interlaminated elements 14, each element 14 itself structurally-interlaminated with adjacent elements 14. Each element 14 may include a plurality of components 15 structurally interlaminated together to form a single structurally-interlaminated element 14. Each component 15 may be disposed in a position off-set from positions of adjacent components 15, such that a first portion 23 of one component 15 may extend beyond the first portion 23 of the adjacent components 15, providing a recess 24 between alternate components 15, configured to receive the extending first portion 23 of a component 15 from an adjacent element 14. In this manner, with each element 14 including components 15 having extending first portions 23 and recesses 24 configured to receive the extending first portions 23, each structurally-interlaminated element 14 may be structurally interlaminated with each adjacent element 14 to form a single structurally interlaminated assembly.

Some embodiments of the presently disclosed method of constructing a marine vessel 10 may further include saturating the first plurality of components and the second plurality of components with a carbon-based resin. Alternatively, or in addition, the third plurality of components and the fourth plurality of components may be saturated with a carbon-based resin. The resin may be adapted to saturate into the porous hardwood, filling the pores of each component 15. The resin is adapted to provide adhesion between each porous hardwood component 15 and to penetrate into the pores of adjacent hardwood components 15, filling the boundaries between each adjacent component with carbon-based resin, to form a continuous structurally interlaminated element 14. Similarly, the carbon-based resin provides adhesion between each adjacent structurally interlaminated element 14, and penetrates into the pores of each adjacent element 14 filling the boundaries between each adjacent element 14, such that each element 14 is structurally interlaminated with each adjacent structurally interlaminated element 14, forming a single structurally interlaminated bonded marine vessel 10. In this manner, each component 15 of the marine vessel 10 is a continuation of each adjacent component 14, increasing the strength and durability of the marine vessel 10 over conventional methods of constructing marine vessels.

In some embodiments, such methods may include the step of applying a first force 25 to a first side 27 of the first combined element 14 and applying a second force 26 opposing the first force 25 to a second side 28 of the first combined element 14 opposite the first side 27 to compress the first element 14 together. Similarly, such methods may include, during formation of each element 14, applying opposing forces to each component 15 of each element 14 such that each component 15 is compressed together, the natural resins and/or fibers of each component 15 combining with the natural resins and/or fibers of each adjacent component 15 to form a single structurally-interlaminated element 14. In turn, each structurally-interlaminated element 14 may be similarly compressively combined such that the natural resins and/or fibers of each adjacent element 14 may combine to form a single unified structure. Such unified structures may be stronger than a structure made from a single piece of wood. Where each component 15 of each element 14 is saturated with carbon-based resin, the compressive opposing forces may cause the carbon-based resin from each component 15 to penetrate into each adjacent component 15 forming a strong structurally-interlaminated bonded element 14, and marine vessel 10.

Further, the method of constructing a marine vessel 10 may include heating a first combined element of the marine vessel 10 to cure the carbon-based resin. Similarly, such methods may include heating a second combined element, a third combined element, and a fourth combined element, having carbon-based resin saturated structurally interlaminated wooden components 15, to cure the carbon-based resin saturated into the pores of each wooden component 15. Each structurally-interlaminated element 14 may be structurally interlaminated with each adjacent structurally-interlaminated element 14 and heated to cure the carbon-based resin to form a single structurally-interlaminated marine vessel 10. The curing of the carbon-based resin crystallizes the carbon-based resin to form a solid, adhesive, water-resistant, and electrically-insulating layer to each component. Heat to cure the carbon-based resin may be provided by any source of heat. Examples of heat sources include constructing a pyre underneath the marine vessel 10 while it is constructed. The pyre is carefully maintained such that the temperature of the atmosphere adjacent the marine vessel 10 is sufficient to cure the carbon-based resin without causing damage to the wooden components 15. Other examples may include constructing portable burners, adapted to be moved to newly constructed sections of the marine vessel and adapted to provide sufficient heat to cure the carbon-based resin. Any fuel may be used for the burners or a pyre, such as wood, for example the waste-wood products from the preparation of the plurality of components 15, or naturally occurring oils.

Figure 4:
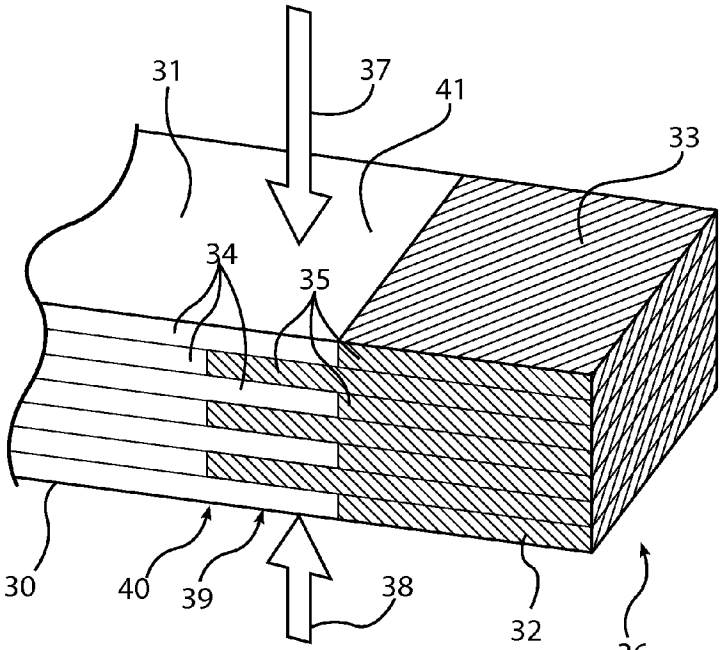
FIG. 4 illustrates an example embodiment of a structurally interlaminated first plurality of components structurally interlaminated with a structurally interlaminated second plurality of components.
Figure 5:
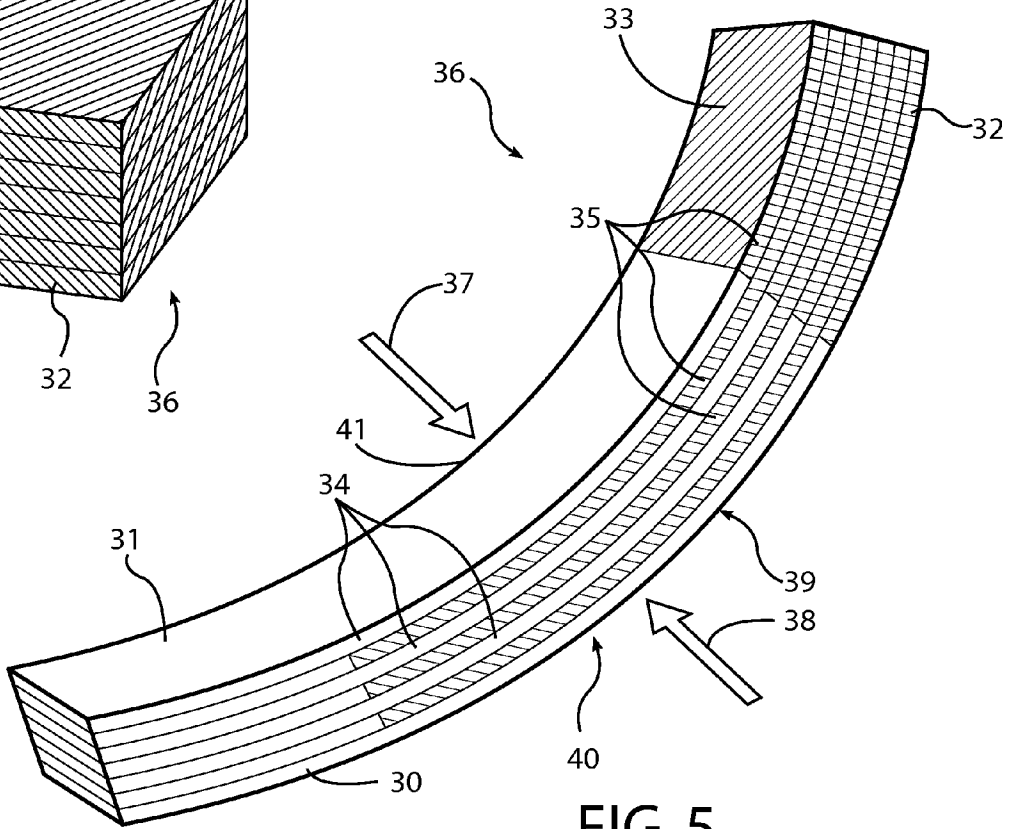
FIG. 5 illustrates an additional example embodiment of a structurally interlaminated first plurality of components structurally interlaminated with a structurally interlaminated second plurality of components.

With reference to FIGS. 4 and 5, there is illustrated an embodiment of structurally interlaminating at least a first portion 34 of a first element 31 with at least a first portion 35 of a second element 33 to form a first combined element 36 of the marine vessel 10. A first plurality of components 30 may be structurally interlaminated to form a first structurally-interlaminated element 31 and a second plurality of components 32 may be structurally interlaminated to form a second structurally-interlaminated element 33. The first plurality of components 30 may be disposed such that a first portion 34 of alternate components 30 may extend beyond the end of each adjacent component 30, such as to form a recess between alternate components, adapted to receive the extending first portion 35 of each alternate component of the second structurally-interlaminated element 33. In this manner each extending first portion 34 of the plurality of components 30 of the first element 31 are interlaminated with the extending first portion 35 of the second plurality of components 32 of the second element 33 to form a single structurally interlaminated combined first element 36.

Similarly, to the single element 14, as referred to with respect to FIG. 3, a first force 37 may be applied to a first side 41, of the structurally interlaminated first combined element 36, at the joint 39, between the first structurally-interlaminated element 31 and the second structurally interlaminated element 33, and a second force 38, opposing the first force 37, may be applied to a second side 40, of the structurally-interlaminated first combined element 36, at the joint 39, to compress together each extending portion 34 of the first plurality of components 30 with each extending portion 35 of the second plurality of components 32. The compressive force may be adapted such that the natural resins and fibers of each of the first plurality of components 30 may penetrate and combine with the natural resins and fibers of each of the second plurality of components 32 to form a continuous first combined element 36.

Additionally, in some embodiments, each of the first plurality of components 30 and the second plurality of components 32 may be saturated with an adhesive filler, such as a carbon-based resin, adapted to penetrate into the pores of each of the first and second plurality of components, and to form a continuous bond between the first plurality of components 30 and the second plurality of components 32. The compressive forces 37 and 38, may cause the resin to further penetrate and bind with the components 30 and 32, furthering the strength of the continuous first combined element 36. As previously stated, heat may be used to cure the carbon-based resin, adding further strength forming a permanent continuous bond between the first element 31 and the second element 33 to form a continuous structurally-interlaminated first combined element 36.

With specific reference to FIG. 5, in some embodiments, a first structurally-interlaminated element 31 having a first plurality of components 30 may be curved. Such curvature may be necessary to form a desired structure, such as the curvature of the hull 11 of the marine vessel 10, as shown in FIG. 1. In some embodiments, each structurally-interlaminated element 31 and 33 may be formed from a plurality of curved components 30 and 32, respectively. In other embodiments, each structurally interlaminated element 31 and 32 may be formed from a plurality of components 30 and 32, respectively, to form straight structurally-interlaminated elements 31 and 32. Each structurally-interlaminated element 31 and 32 may then undergo a process to impart a curvature. In further embodiments, each straight structurally-interlaminated element 31 and 32 may be structurally interlaminated with other elements disposed to form a frame for the marine vessel 10. For example, the structurally-interlaminated elements 31 and 32 may be structurally interlaminated with adjacent structurally-interlaminated elements of the marine vessel 10 such as the bulkheads 12, as shown in FIG. 1, the position of each successive bulkhead 12 forcing a curvature into structurally-interlaminated elements 31 and 32.

Curvature may be imparted into each of the plurality of components 30 and 32 in any variety of ways. For example, in some embodiments, each component 30, 32, may be horizontally supported at each end, and raised above the ground. A force may be applied at a desired position along the length, between the supports, of each component 30, 32 such that each component may bow at the desired position between the supports. Such a force may be provided by a weight positioned on top of each component 30, 32 attracted downward by gravity. In other embodiments, such a force may be provided by a restraint, disposed at a desired position between the supports, the restraint adapted to pull each component 30, 32 inward, against the supports, to impart a bow into each component 30, 32. The supports may be disposed at any desired position along the length of each component 30, 32, and the force may be applied at any desired position between the supports, such as to permit any form of curvature to each component 30, 32. In further embodiments, a force may be provided at the ends of each component 30, 32, the force adapted to push inwardly toward the center of each component 30, 32, causing each component to bow and impart a curvature into each component 30, 32.

In an embodiment where each component 30, 32 is formed from porous hardwood, the process to impart a curvature into each wooden component 30, 32, may be enhanced by saturating each component 30, 32, with water to soften the fibers of each wooden component 30, 32. Further, each wooden component 30, 32 may be heat-treated to soften the fibers, thereby permitting the wooden components 30, 32 to have an increased curvature without losing post-curvature strength. In such embodiments, each wooden component 30, 32 may be dried and then saturated with carbon-based resin to preserve the curvature of the wooden component 30, 32.

Figure 6:
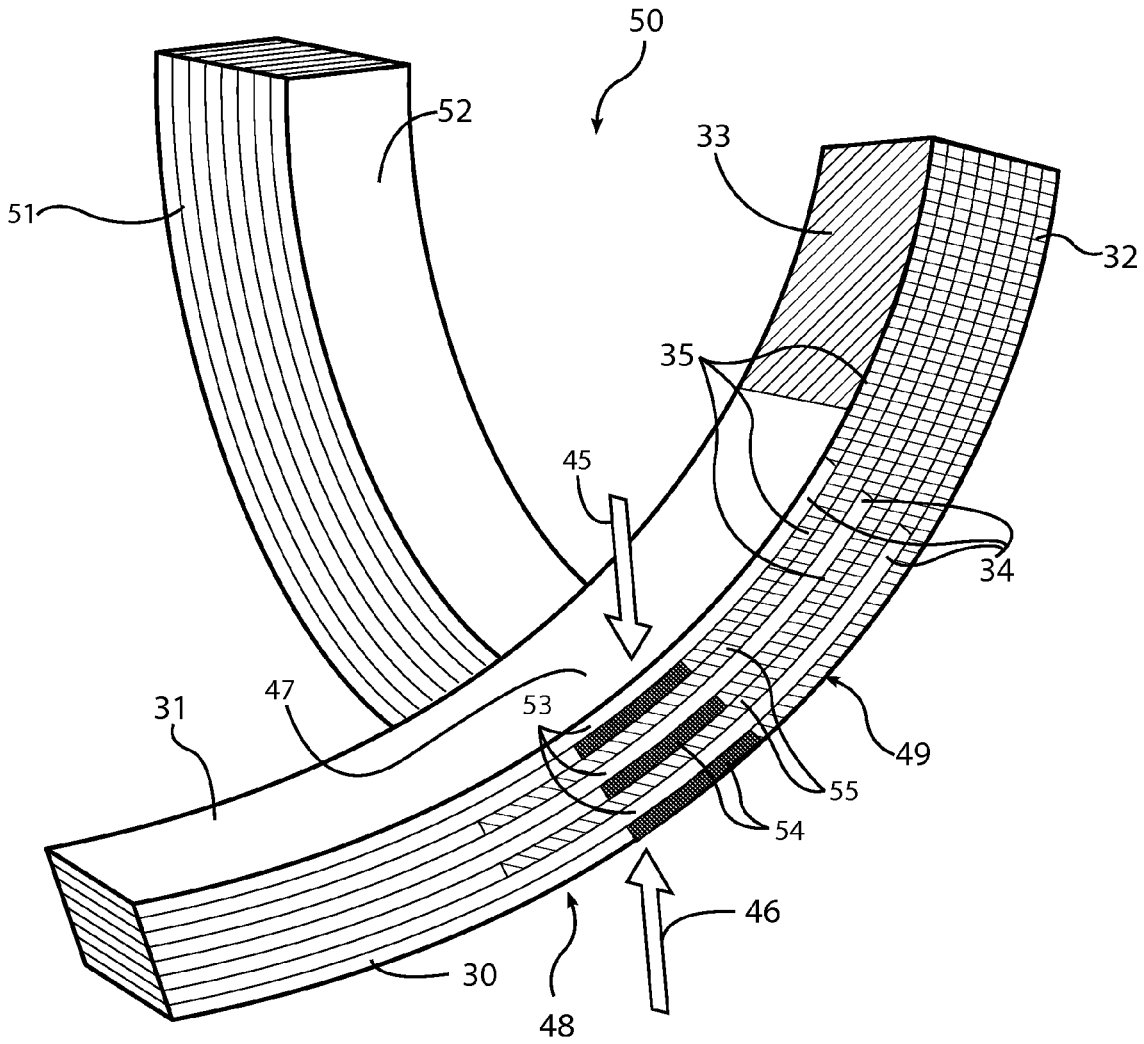
FIG. 6 illustrates an example embodiment of a structurally interlaminated first plurality of components, a structurally interlaminated second plurality of components, and a structurally interlaminated third plurality of components, themselves structurally interlaminated together.

With reference to FIG. 6, there is shown an example of an embodiment of a second combined element 50 formed by an embodiment of the presently disclosed method including the steps of structurally interlaminating a third plurality of components 51 to form a third element 52 of the marine vessel 10, and structurally interlaminating at least a second portion 53 of the first element 31 with at least a first portion 54 of the third element 52 to form a second combined element of the marine vessel 10. In some embodiments, the second portion 53 of the first element 31 may overlap with the first portion 34 of the first element 31, as shown in FIG. 6. In other embodiments, the second portion 53 of the first element 31 may be disposed at a different position relative to first portion 34 of the first element 31. Alternatively, or in addition, other embodiments of the presently disclosed method may include the step of structurally interlaminating a third plurality of components 51 to form a third element 52 of the marine vessel 10, and structurally interlaminating at least a second portion 55 of the second element 33 with at least a first portion 54 of the third element 52 to form a second combined element 50 of the marine vessel 10. Similarly, the second portion 55 of the second element 33 may overlap with the first portion 35 of the second element 33, as shown in FIG. 6. Alternatively, the second portion 55 of the second element 33 may be disposed at a different position relative to the first portion 35.

FIG. 6 illustrates a first structurally-interlaminated element 31 having a first plurality of components 30, a second structurally-interlaminated element 33 having a second plurality of components 35, and a third structurally-interlaminated element 52 having a third plurality of components 51. A first portion 34 of the first structurally-interlaminated element 31 is structurally interlaminated with a first portion 35 of the second structurally-interlaminated element 33. A first portion 54 of the third structurally-interlaminated element 52 is structurally interlaminated with a second portion 53 of the first structurally-interlaminated element 31 and also with a second portion 55 of the second structurally-interlaminated element 33. The first portions 34 and 35, and second portions 53 and 55, of the first structurally-interlaminated element 31 and the second structurally-interlaminated element 33, respectively, overlap.

A first force 45 may be applied to a first side 47, of the structurally interlaminated second combined element 50, at the joint 49, between the first structurally-interlaminated element 31, the second structurally interlaminated element 33, and the third structurally-interlaminated element 52, and a second force 46, opposing the first force 45, may be applied to a second side 48, of the structurally-interlaminated second combined element 50, at the joint 49, to compress together the extending portions 34, 35, and 54 of the first plurality of components 30, second plurality of components 32, and third plurality of components 51, respectively. The compressive forces 45, 46 may be adapted such that the natural resins and fibers of each of the first, second and third plurality of components 30, 32, and 51, respectively, may penetrate and combine with the natural resins and fibers of each adjacent component to form a continuous second combined element 50.

As can be seen in FIG. 6, the first, second, and third structurally-interlaminated elements, 31, 33, and 52, respectively, have a curved shape and intersect at right-angles. In other embodiments the first, second, and third structurally-interlaminated elements 31, 33, and 52, respectively, may be of any shape and may intersect at any angle. Furthermore, FIGS. 4 to 6 illustrate elements structurally interlaminated with adjacent elements at their minor dimensions, in other embodiments the elements, having a plurality of structurally-interlaminated components, may be structurally-interlaminated at their major dimensions.

Figure 7:
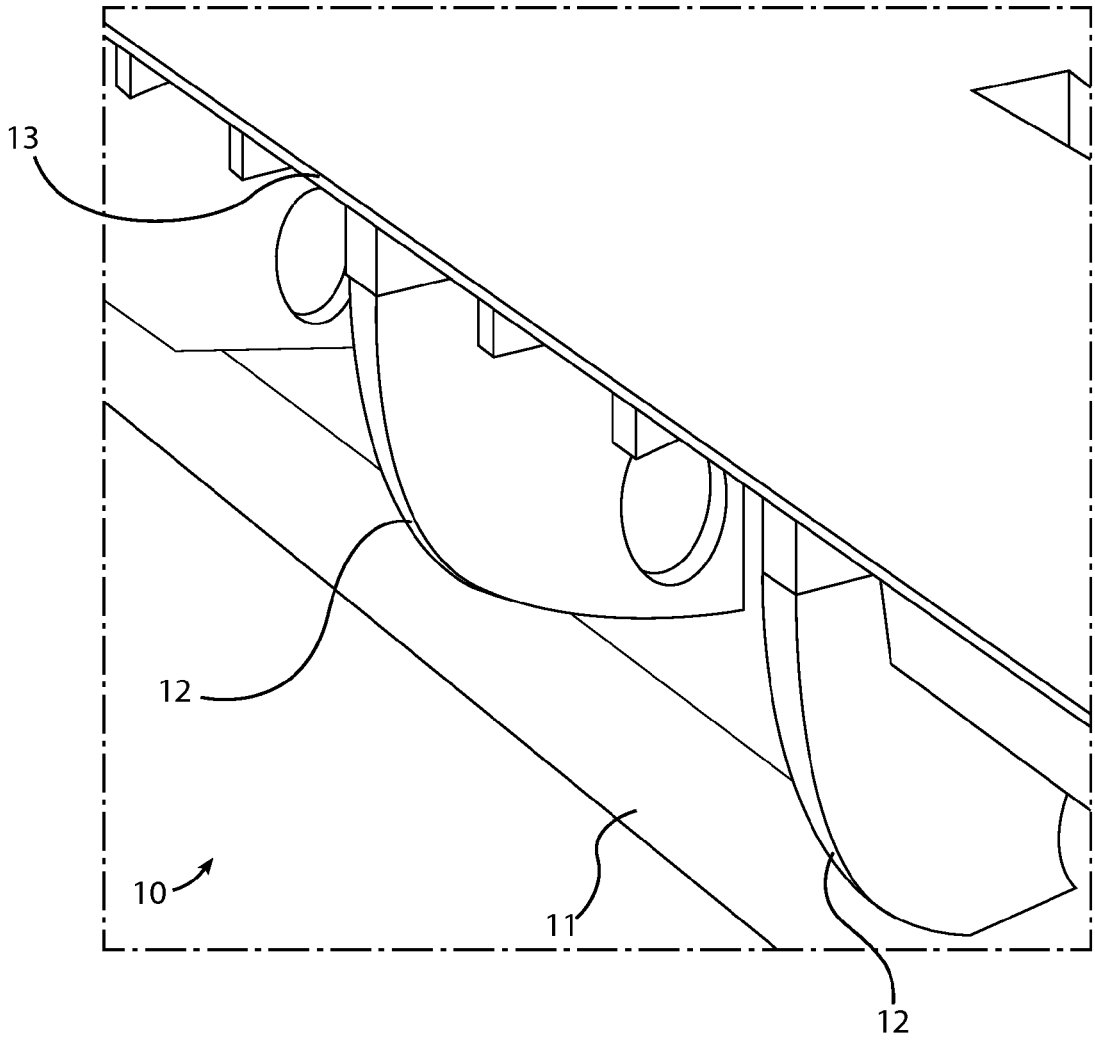
FIG. 7 illustrates an example embodiment of a structurally interlaminated hull, bulk-head and deck, themselves structurally interlaminated together.

Referring now to FIG. 7, there is illustrated a portion of a marine vessel 10 constructed by an embodiment of the presently disclosed methods. The marine vessel has a hull 11 having a plurality of structurally interlaminated elements 14, each structurally interlaminated element formed from a plurality of structurally interlaminated components 15. Also, the marine vessel 10 has at least one bulkhead 12 having a plurality of structurally interlaminated elements 14, each structurally interlaminated element formed from a plurality of structurally interlaminated components 15. Further, the marine vessel 10 has at least one deck member 13 having a plurality of structurally interlaminated elements 14, each structurally interlaminated element formed from a plurality of structurally interlaminated components 15. Such elements 14 and components 15 may have any shape and take any form. The elements of the deck member 13 may have a different shape and take on different characteristics compared with the elements of the hull 11 and the bulkheads 12, for example.

The plurality of components 15, forming the structurally-interlaminated hull 11, may be structurally-interlaminated to form a single combined hull 11. In some embodiments, the hull 11 may be constructed as a single structure, from the bottom, upwardly, laying the lowest component first and structurally-interlaminating each adjacent component 15 upwardly to form the hull 11. In other embodiments, the hull 11 may be constructed in individual sections, each section having a plurality of structurally-interlaminated components 15, and each section structurally-interlaminated with adjacent structurally-interlaminated sections to form the hull 11. Each structurally-interlaminated bulkhead 12 may be constructed in-place, concurrently with the hull 11, while the hull 11 is being constructed upwardly from the bottom, where each bulkhead component adjacent the hull 11 is structurally interlaminated with the adjacent hull components. Alternatively, each structurally-interlaminated bulkhead 12 may be constructed separately, by structurally-interlaminating a plurality of components with adjacent components, where each bulkhead component is structurally interlaminated with adjacent hull components. In either embodiment, the bulkhead 12 is structurally interlaminated with the hull 11 and forms a single continuous structure, stronger than a bulkhead and hull combined using conventional methods.

FIG. 7 also illustrates a portion of a structurally-interlaminated deck 13, structurally interlaminated with the hull 11 and the bulkhead 12. The deck 13 may be constructed, separately or concurrently with the hull 11 and the bulkhead 12, of a plurality of components structurally interlaminated with adjacent components. Each deck component and adjacent bulkhead component is structurally interlaminated together, and each deck component and adjacent hull component is structurally interlaminated together to form a single continuous structure.

In this manner the hull 11, the at least one bulkhead 12, and the at least one deck member 13, are structurally interlaminated with each other to form a single integrated structurally interlaminated marine vessel 10. Such a marine vessel 10 is stronger than a marine vessel 10 made from conventional methods. Each component 15 of the marine vessel 10 may be made of porous hardwood and may also be saturated in carbon-based resin, adapted to penetrate into the pores of each component 15 and bind adjacent interlaminated components 15 to form a single element 14. The carbon-based resin may be adapted to seal the components 15, inhibiting the ingress of water into the structurally-interlaminated elements 15 and the structurally-interlaminated marine vessel 10. Such carbon-based resin may include any resin, such as a naturally occurring carbon-based resin, for example birch-bark resin. The carbon-based resin may be adapted to crystallize upon curing, providing an impermeable barrier to water, and also a non-conducting barrier, protecting the internal areas of the marine vessel 10 from electromagnetic discharge, for example.

Figure 8:
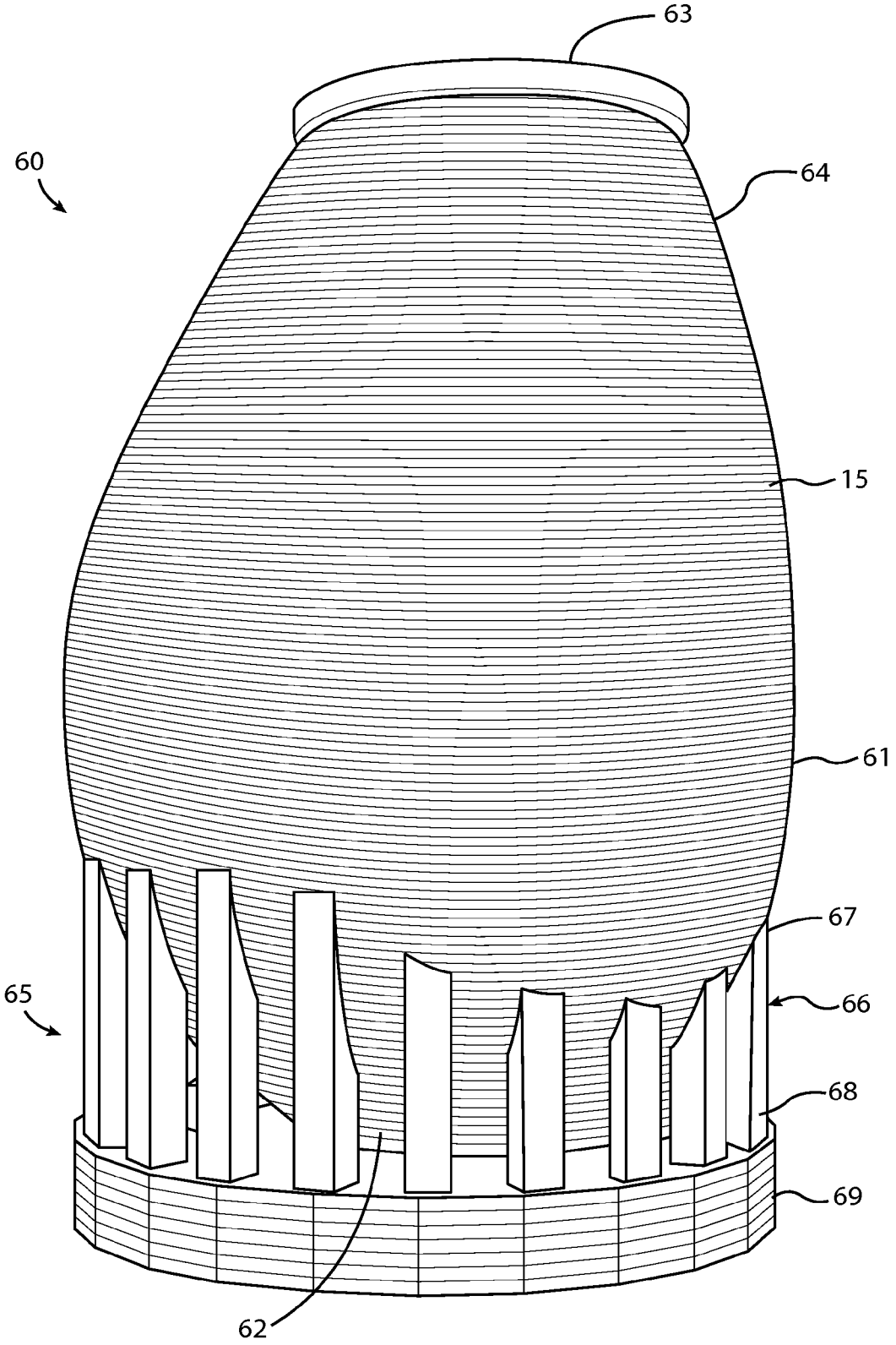
FIG. 8 illustrates an example embodiment of a structurally interlaminated water vessel.

FIG. 8 illustrates a water vessel 60 having a plurality of structurally-interlaminated components. The water vessel has a bottom portion 61 extending from a base portion 62 and curved upwardly to a rim portion 63 at the top 64 of the water vessel 60. Each structurally-interlaminated component may be saturated with a carbon-based resin, the carbon-based resin adapted to waterproof the bottom portion 61 of the water vessel 60. The water vessel 60 may also have a stand 65, each component of the stand 65 structurally interlaminated, increasing the strength of the stand 65. The stand 65 may include vertical portions 66. A first portion 67 of the vertical portions 66 may be interlaminated with the bottom portion 61 of the water vessel 60. A second portion 68 of the vertical portions 66 may be interlaminated with a ring portion 69 of the stand 65. The ring portion 69 is configured to distribute the weight of the water vessel 60 evenly around the circumference of the ring portion 69. As shown in FIG. 1, each component of the ring portion 69 adjacent other structures of the marine vessel 10 may be structurally interlaminated with the components of those other structures. The rim portion 63 of the water vessel 60 may also be structurally interlaminated with the marine vessel 10. In this manner, the water vessel 60 may be structurally integrated with the marine vessel 10, providing structural support to the marine vessel 10. The water vessel 60 may be adapted to hold drinking water in quantities to provide sufficient drinking water to the occupants of the marine vessel 10 over an extended period of time. The marine vessel 10 may include any number of water vessels 60, and each water vessel 60 may have different dimensions, some providing structural stability for the marine vessel 60, such as that shown in FIG. 1, and others adapted for use in localized areas of the marine vessel 60.

Figure 9:
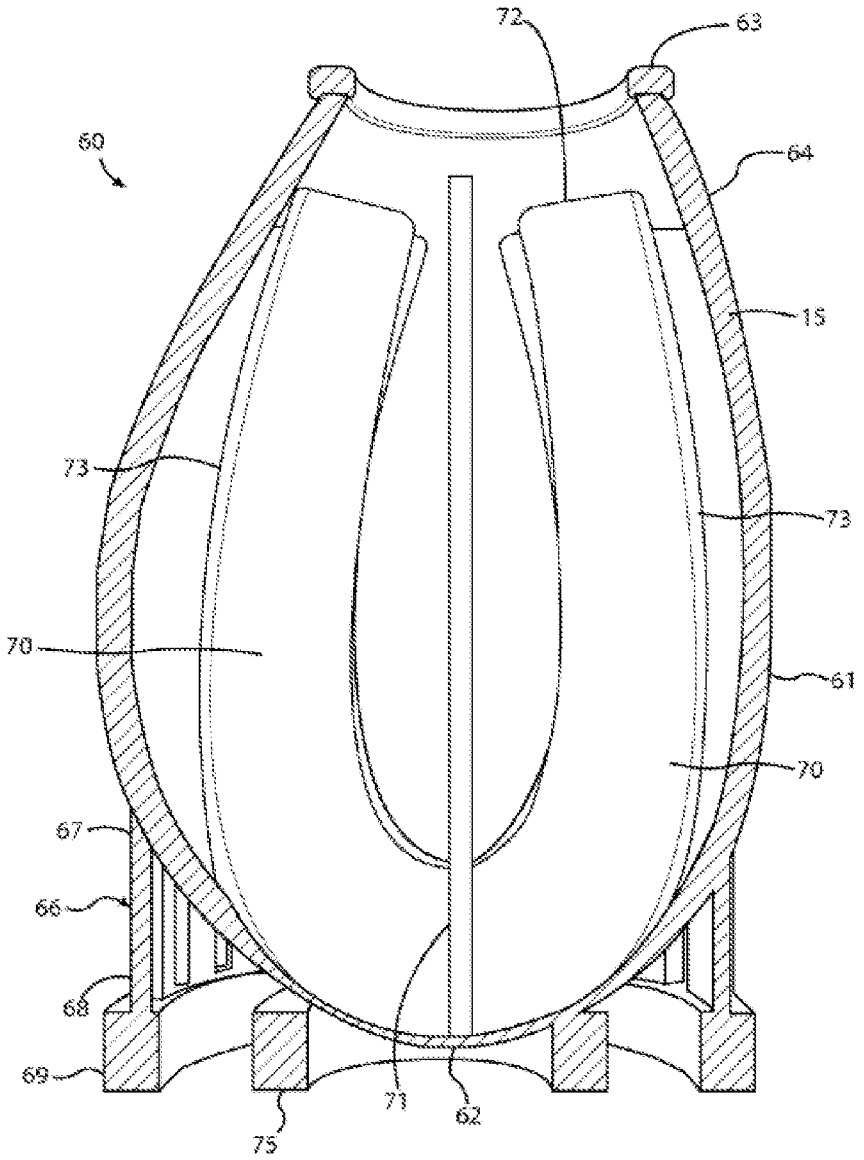
FIG. 9 illustrates a partial cross-section of an example embodiment of a structurally interlaminated water vessel.

FIG. 9 illustrates the internal portions of a water vessel 60. The water vessel 60 includes at least one support member 70 distributed internally within the water vessel 60. Each support member 70 may include a first portion 71 configured to be structurally interlaminated with the bottom portion 61 of the water vessel 60 at the water vessel base 62 as well as with the first portion 71 of other support members 70, and a second portion 72 extending toward the top portion 64 of the water vessel 60 configured to be structurally interlaminated with the sides and top portion 64 of the water vessel 60. Each support member 70 may also include a first side 73 configured to structurally interlaminate with the bottom portion 61 of the water vessel 60 from the water vessel base 62 to the water vessel top 64, the support member first side 73 being structurally interlaminated with the wall of the water vessel 60. The support members 70 may be configured to provide vertical and horizontal support to the water vessel 60, inhibiting torsional stresses on the water vessel 60 from the weight of the water in the water vessel 60 or from the weight of and forces from the marine vessel 10.

Similarly to the water vessel 60, each of the at least one support members 70 may include a plurality of interlaminated components 15, each component 15 saturated with a carbon-based resin, the carbon-based resin adapted to provide adhesion between each component 15 and also provide water resistant properties, inhibiting the ingress of water into the support member 70, reducing the tendency of the support member 70 to rot in the water-filled water vessel 60. The components 15 of the support members 70 may be structurally interlaminated with the sides of the water vessel 60 to form a single structure. The construction of the support members 70 may be integrated with the construction of the water vessel 60. Alternatively, the support members 70 may be constructed separately from the water vessel 60 and structurally interlaminated with the water vessel 60 after the water vessel 60 has been constructed.

The stand 65 may further comprise an inner ring portion 75 positioned inward of the outer ring portion 69, closer to the base 62 of the water vessel 60. The inner ring portion 75 adapted to support at least a portion of the weight of the water-filled water vessel 60. The inner ring portion 75 may include a plurality of structurally interlaminated components 15 and may also be structurally interlaminated with the bottom portion 61 of the water vessel 60 adjacent the base 62. Alternatively, or in addition, the inner ring portion 75 may be structurally interlaminated with the deck 13, at least one bulkhead 12, or hull 11 upon which the stand 65 is positioned. Similarly, the outer ring portion 69 may also be structurally interlaminated with portions of the marine vessel 10.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. A method of constructing a wooden marine vessel, said method comprising:

structurally interlaminating a first plurality of wooden components to form a first element of a wooden marine vessel;

structurally interlaminating a second plurality of wooden components to form a second element of said wooden marine vessel; and structurally interlaminating at least one of the first plurality of wooden components with at least one of the second plurality of wooden components to form a first combined element of said wooden marine vessel.

2. The method of claim 1, further comprising:

structurally interlaminating a third plurality of components to form a third element of said marine vessel; and structurally interlaminating at least one of the third plurality of components with at least one of the first plurality of components to form a second combined element of said marine vessel.

3. The method of claim 2, further comprising:

structurally interlaminating a fourth plurality of components to form a fourth element of said marine vessel; and structurally interlaminating at least one of the fourth plurality of components with at least one of the second plurality of components to form a third combined element of said marine vessel.

4. The method of claim 1, further comprising saturating said first plurality of components and said second plurality of components with a carbon-based resin.

5. The method of claim 4, further comprising heating said first combined element of said marine vessel to cure said carbon-based resin.

6. The method of claim 1, further comprising applying a first force to a first side of said first combined element and applying a second force opposing said first force to a second side of said first combined element opposite said first side to compress said first combined element together.

7. A wooden marine vessel, the marine vessel comprising:

a hull comprising a first plurality of wooden elements that are structurally interlaminated with each other, wherein each of said first plurality of wooden elements is formed from a plurality of structurally interlaminated wooden components;

at least one bulkhead comprising a second plurality of wooden elements that are structurally interlaminated with each other, wherein each of said second plurality of wooden elements is formed from a plurality of structurally interlaminated wooden components; and at least one deck member comprising a third plurality of wooden elements that are structurally interlaminated with each other, wherein each of said third plurality of wooden elements is formed from a plurality of structurally interlaminated components.

8. The marine vessel of claim 7 wherein the hull, the at least one bulkhead, and the at least one deck member are structurally interlaminated with each other to form a single integrated structurally interlaminated marine vessel.

9. The marine vessel of claim 7 wherein the plurality of structurally interlaminated components comprise porous hardwood.

10. The marine vessel of claim 7 further comprising a carbon-based resin saturated into the plurality of structurally interlaminated components.

11. The marine vessel of claim 10 wherein the carbon-based resin seals said plurality of structurally interlaminated components, inhibiting the ingress of water into the first, second, and third plurality of elements.

12. The marine vessel of claim 10 wherein the carbon-based resin comprises birch-bark resin.

13. The marine vessel of claim 8 further comprising at least one water vessel comprising a plurality of structurally interlaminated elements configured for holding water.

14. The marine vessel of the claim 13 wherein said at least one water vessel is structurally interlaminated with the structurally interlaminated marine vessel and configured to provide structural support to the structurally interlaminated marine vessel.

* * * * *